US006032761A

United States Patent [19]

Coste et al.

[11] Patent Number: 6,032,761

[45] Date of Patent: Mar. 7, 2000

[54] ELEVATOR HOISTWAY TERMINAL ZONE POSITION CHECKPOINT DETECTION APPARATUS USING A BINARY CODING METHOD FOR AN EMERGENCY TERMINAL SPEED LIMITING DEVICE

[75] Inventors: Steven D. Coste, Berlin; August J. Dobler, West Simsbury, both of Conn.

[73] Assignee: Otis Elevator, Farmington, Conn.

[21] Appl. No.: 09/067,294

[22] Filed: Apr. 27, 1998

[51] Int. Cl.[7] ..... B66B 1/28

[52] U.S. Cl. ..... 187/294

[58] Field of Search ..... 187/284, 291, 187/293, 294

[56] References Cited

U.S. PATENT DOCUMENTS

| | | | |
|---|---|---|---|
| 3,599,755 | 8/1971 | Lund et al. | 187/293 |
| 3,972,389 | 8/1976 | Faup | 187/29 R |
| 4,245,721 | 1/1981 | Masel | 187/29 R |
| 4,278,150 | 7/1981 | Wehrli, III et al. | 187/29 R |
| 4,304,319 | 12/1981 | Radke | 187/29 R |
| 4,485,895 | 12/1984 | Tachino et al. | 187/29 R |
| 4,503,939 | 3/1985 | Lawrence et al. . | |
| 4,515,247 | 5/1985 | Caputo | 187/29 R |
| 4,658,935 | 4/1987 | Holland | 187/122 |
| 4,691,807 | 9/1987 | Iwata . | |
| 5,085,294 | 2/1992 | Iwata | 187/134 |
| 5,345,048 | 9/1994 | Towey, Jr. . | |
| 5,393,941 | 2/1995 | Mizuno et al. | 187/293 |
| 5,407,028 | 4/1995 | Jamieson et al. . | |
| 5,637,841 | 6/1997 | Dugan et al. . | |
| 5,848,671 | 12/1998 | Kattainen | 187/291 |

*Primary Examiner*—Jonathan Salata

[57] ABSTRACT

An emergency terminal speed limiting device (ETSLD) uses terminal zone position checkpoint detection with a binary coding method for the sensible stationary part mounted in the terminal zone. Instead of using three separate stationary vanes of different lengths as cams for actuating three separate switches on the car as they pass by the cams, only two vanes are needed. They can be of shorter length, e.g. equal length, and overlapped in a central part of the terminal zone to create three distinct subzones to thereby create a sensible binary coded subzone indicator. The boundaries of the subzones can be used as position checkpoints. Material and manpower for installation are thereby reduced. The stationary part need not be vanes but could take other forms such as reflective tape. Likewise, the moving sensor part can be other than a cam-operated switch, such as an optical transceiver.

15 Claims, 8 Drawing Sheets

ELEVATOR HOISTWAY TERMINAL ZONE POSITION CHECKPOINT DETECTION APPARATUS USING A BINARY CODING METHOD FOR AN EMERGENCY TERMINAL SPEED LIMITING DEVICE

BACKGROUND OF THE INVENTION

1. Technical Field of the Invention

The invention relates to an emergency terminal speed limiting device for an elevator and, more particularly, to improvements in the detection of position checkpoints in terminal zones of the elevator hoistway.

2. Discussion of Related Art

It is known in the elevator art to define terminal zones at both ends of the elevator hoistway. It is desired that the elevator car stop normally at a top or bottom landing of the hoistway in such a terminal zone. In the event the elevator car enters a terminal zone, it is necessary to provide a primary means for controlling the elevator car as well as one or more backup means. One such backup means is called emergency terminal speed limiting. For checking the position of the car, conventional emergency terminal speed limiting devices use vanes mounted in the terminal zones of the hoistway. The vanes act as cams used to actuate switches that are mounted on the elevator car. Each switch has an arm attached to a roller that rolls along the cam as the car passes by the cam thereby actuating the switch. Since the terminal zone is often on the order of twenty-five meters or more in length, these vanes are quite long. Consequently, transport of these vanes from factory to hoistway is difficult, not to mention difficulties in their installation. Since one sensor track is used for each of the position checkpoints, one vane is used for each such position checkpoint in each terminal zone. As a result, there is a great deal of material and manpower used for the installation of these vanes and there is one switch needed for each vane.

SUMMARY OF INVENTION

An object of the present invention is to provide method and apparatus for position checkpointing in elevator hoistway terminal zones that is less wasteful of material and installation manpower.

According to a first aspect of the present invention, an elevator hoistway terminal zone position checkpoint detection apparatus, comprises a stationary part having plural elongated sections, for vertical mounting along a terminal zone of an elevator hoistway, having at least one section overlapping in part another section so as to form at least one overlapping portion and at least two non-overlapping portions; and a movable part, for mounting on an elevator car movable in said hoistway for sensing boundaries of said overlapping portion and said non-overlapping portions as indicative of position checkpoints in said terminal zone and for providing a sensed output signal indicative of said position checkpoints. The elongated sections of said stationary part may comprise vanes or cams for mounting along said terminal zone of said elevator hoistway. In that case, the movable part may comprise at least two cam operated switches. Or, the movable part may comprise optical sensors for sensing such vanes or cams. Another way is to have the elongated sections of the stationary part comprising a light reflective means for mounting along said terminal zone of said elevator hoistway. In that case, the movable part also comprises optical sensors for sensing said light transmitted to and reflected back from the reflective means.

According to a second aspect of the present invention, an elevator emergency terminal speed limiting device, comprises an elevator hoistway terminal zone position checkpoint detection means utilizing a binary coding method for providing a binary coded output signal indicative of position checkpoints in an elevator hoistway terminal zone; and decision means, responsive to said binary coded output signal, for retrieving a velocity reference signal corresponding to a position checkpoint associated with said binary coded output signal and for comparing said velocity references signal to an actual velocity signal indicative of an actual velocity of an elevator car in said elevator hoistway for providing a trip signal for stopping said elevator car in the presence of said actual velocity signal being greater than said velocity reference signal. In that case, the hoistway terminal zone position checkpoint detection means can be according to the first aspect of the invention.

According to a third aspect of the invention, a method comprises the steps of (1) receiving a binary coded sensed output signal having a magnitude indicative of one of a plurality of position checkpoints in an elevator hoistway terminal zone of an elevator hoistway; (2) retrieving, in response to said binary coded sensed output signal, a reference velocity signal associated with said one checkpoint; (3) retrieving an actual car velocity signal having a magnitude indicative of an actual velocity of an elevator car moving in said elevator hoistway; and (4) comparing said reference velocity signal to said actual car velocity signal for providing a trip command output signal in the presence of said actual car velocity signal having a magnitude greater than said reference velocity signal. The binary coded sensed output signal can thus be provided by an elevator terminal zone position checkpoint detection means encoded using a binary coding method.

According to a fourth aspect of the present invention, the above method can further comprise the parallel step of sensing for the presence of said elevator car in said terminal zone by: (1) determining if said elevator car is transitioning from outside said terminal zone into said terminal zone by detecting a transition from a zero state indicative of said elevator car outside said terminal zone to a first state corresponding to a first position checkpoint of said terminal zone in which a pair of elongated sections do not overlap for providing a first checkpoint output signal; (2) determining if said elevator car is transitioning from said first state to a second state corresponding to a second position checkpoint of said terminal zone in which said pair of elongated sections do overlap for providing a second checkpoint output signal; and (3) determining if said elevator car is transitioning from said second state to a third state corresponding to a third position checkpoint of said terminal zone in which said pair of elongated sections again do not overlap for providing a third checkpoint output signal. Of course the fourth aspect of the invention can be executed independently from the method according to the third aspect of the invention.

As described above, conventional ETSLD designs using vanes mounted in the hoistway face a dilemma of requiring long vanes and one sensor track for each of up to three velocity/position checkpoints. The present invention reduces vane length significantly and provides up to three of these checkpoints with only two sensor tracks. By virtue of shorter vane lengths, installation is simplified and therefore material and manpower savings can be realized. The elimination of a sensor track for a three checkpoint design reduces cost such that the three checkpoints are provided for less than the cost of two with previous designs.

These and other objects, features and advantages of the present invention will become more apparent in light of the detailed description of a best mode embodiment thereof, as illustrated in the accompanying drawings.

DETAILED DESCRIPTION OF PREFERRED EMBODIMENTS

Figure 2:
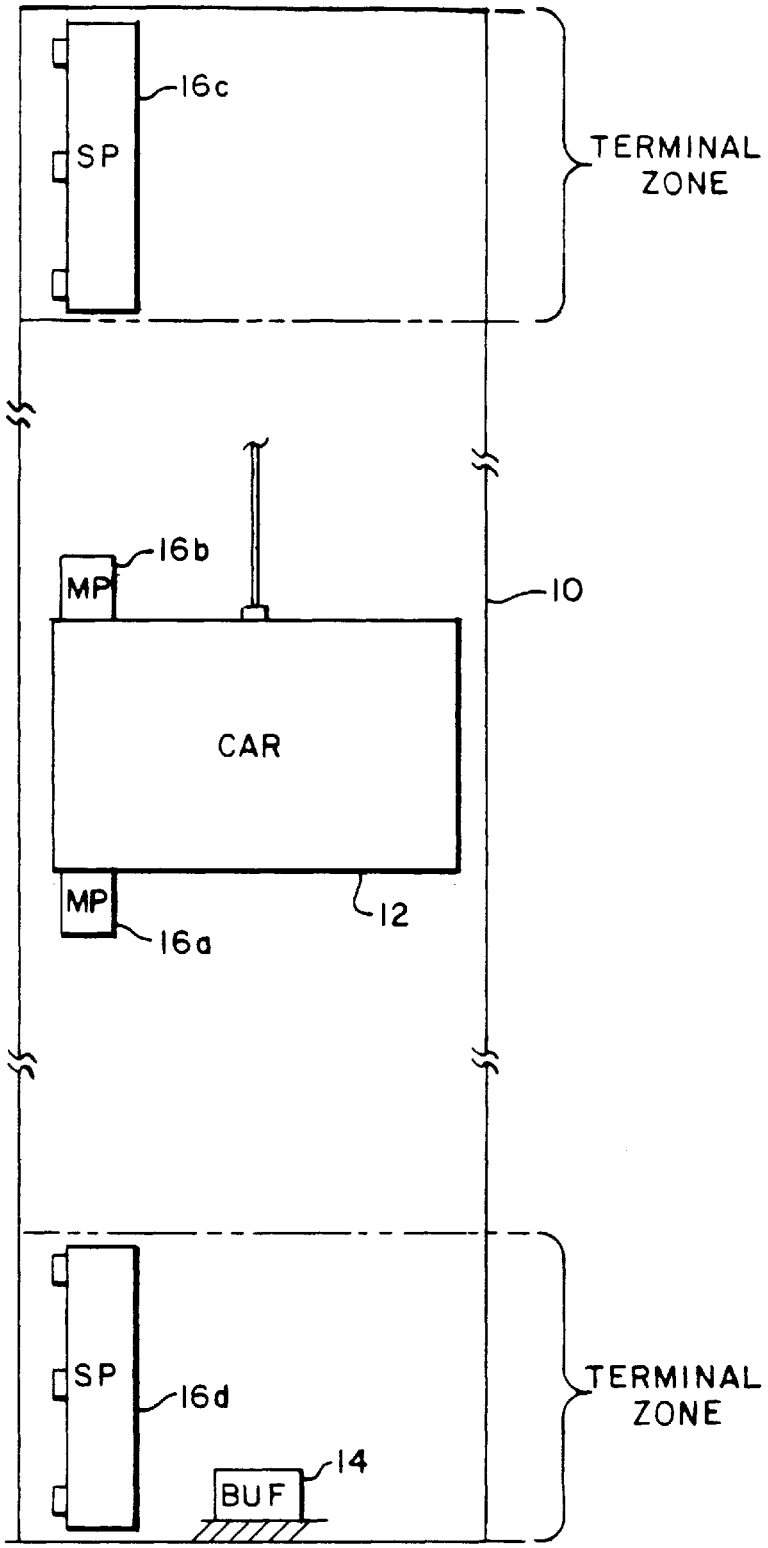
FIG. 2 PRIOR ART
FIG. 2 illustrates, according to both the prior art and the present invention, an elevator hoistway having an elevator car therein for moving vertically in the hoistway between terminal zones thereof, wherein the zones each include a stationary part of a position checkpoint detection apparatus and wherein the elevator car has a movable part of the position checkpoint detection apparatus for each terminal zone mounted thereon.

FIG. 2 shows an elevator hoistway 10, according to the prior art, in which an elevator car 12 moves vertically up and down the hoistway to serve passengers boarding and deboarding at various hoistway landings corresponding to floors in the building which the hoistway serves. The hoistway includes terminal zones at each end of hoistway. The top landing of the building will normally be located within the top terminal zone as will the lobby or basement landing normally be located within the bottom terminal zone. As a safety measure, should the elevator car enter a terminal zone, it is necessary to provide for a failure of the normal stopping means. These safety measures can take various forms including a controlled slowdown to stop before reaching the top or bottom of the hoistway. For instance, in the bottom terminal zone shown in FIG. 2, before being stopped by a buffer 14, certain elevator codes require a slowdown at a rate that will ensure striking the buffer with a speed that is no greater than its rated striking speed.

It is still possible, however, that normal control of such a controlled slowdown with a terminal zone might fail. In that event, it is usually the practice to provide a backup slowdown means. One such backup, among others, is an emergency terminal speed limiting device (ETSLD) to signal a trip mechanism to stop the elevator by other means. Such a means might be a trip signal 100 to disconnect motor power and to drop the brake to stop the elevator.

As part of the emergency terminal speed limiting device, a position checkpoint detection means is utilized. This is indicated in FIG. 2 for each terminal zone by a moving part (MP) 16*a* on the car 12, e.g., on the bottom, and a moving part (MP) 16*b* also on the car. These moving parts 16*a*, 16*b* are "moving" by virtue of being fixedly mounted on a moving car 12. Corresponding stationary parts (SP) 16*c*, 16*d* are illustrated in the top and bottom terminal zones. These stationary parts 16*c*, 16*d* are stationary by virtue of being mounted fixedly in the respective terminal zones of the hoistway 10. Each of the stationary parts 16*c*, 16*d* typically includes several vanes mounted on the hoistway wall in the terminal zone. Each moving part 16*a*, 16*b* includes a corresponding number of switches for sensing the individual vanes, one vane and switch pair for each position checkpoint. These vanes are of differing lengths but one will typically extend the entire length of the terminal zone while the others occupy differing lengths that are shorter than the entire length of the terminal zone.

Figure 3:
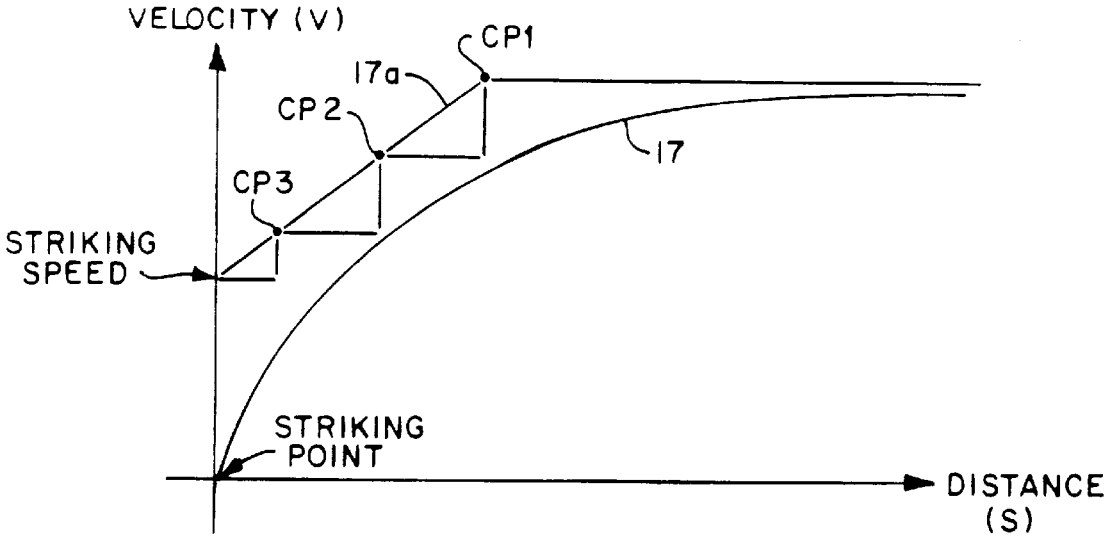
FIG. 3 illustrates position checkpoints in a terminal zone of an elevator hoistway in comparison with a normal terminal speed stop curve, as known in the art.

FIG. 3 shows a typical prior art normal terminal zone stopping curve 17 for the bottom of the hoistway plotted in a velocity/distance coordinate system. The normal terminal stopping curve is shown plotted below a series of position checkpoints (CP1, CP2, CP3) along a brake curve 17*a* for emergency terminal speed limiting. For the normal terminal stopping curve 17, the speed decreases gradually to zero just prior to the striking point of the buffer. As a check or backup for normal terminal stopping, however, a position checkpoint detection means is used as part of an emergency terminal speed limiting device. Should the speed of the car at the various position checkpoints be detected at greater than a reference value unique for each checkpoint, then the elevator car is shutdown by other means. This will result in the elevator car striking the buffer at or below the indicated striking speed reached at a deceleration no greater than the slope shown in FIG. 3 as dictated by the reference velocities at the various position checkpoints.

Figure 4:
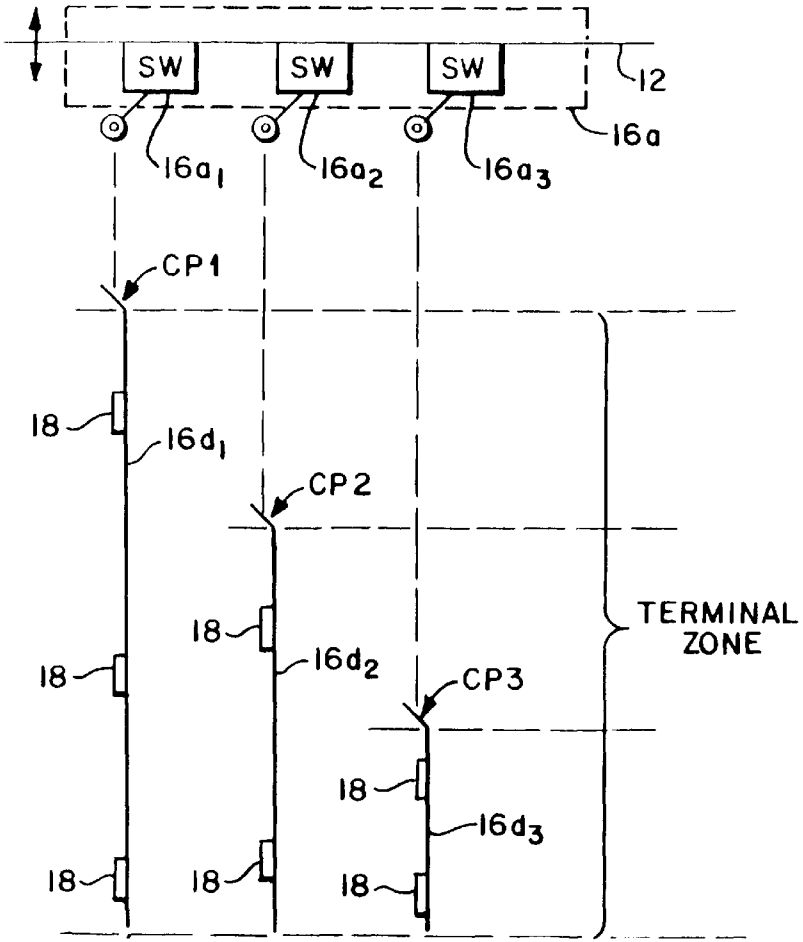
FIG. 4 PRIOR ART
FIG. 4 shows a conventional hoistway switch and vane arrangement for use as the movable and stationary parts, respectively, of a position checkpoint detection means, according to the prior art.

FIG. 4 shows a plurality of prior art vanes or cams $\mathbf{16}d_1$, $\mathbf{16}d_2$, $\mathbf{16}d_3$ mounted e.g. by means of brackets 18 on e.g. a wall of the hoistway 10. Note that the first vane $\mathbf{16}d_1$ extends the entire length of the terminal zone. The second vane $\mathbf{16}d_2$ extends only about two-thirds of the extent of the terminal zone. The third vane $\mathbf{16}d_3$ extends only about on-third of the extent of the terminal zone.

Figure 5:
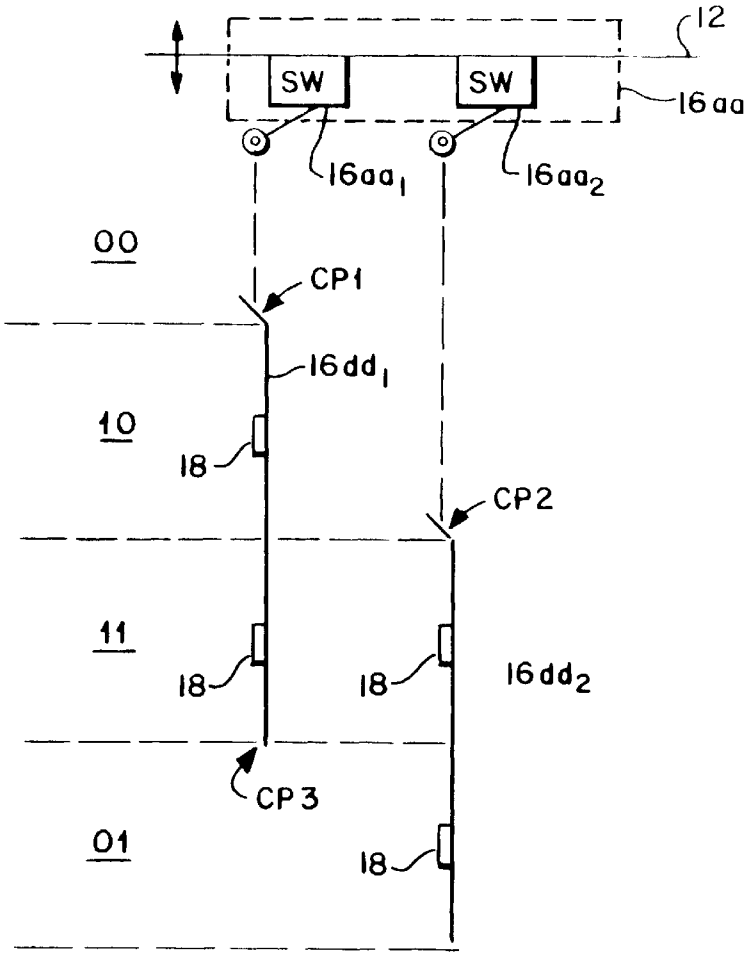
FIG. 5 is similar to FIG. 4 except showing a stationary part of position checkpoint detection means having plural elongated vane sections which overlap, according to the present invention, to provide a binary coded indication of position checkpoints in the hoistway.

According to the present invention, as shown for example in FIG. 5, it is not necessary to use a separate vane for each position checkpoint in the terminal zone. Instead, for example, only two vanes 16$dd_1$, 16$dd_2$ are necessary. By arranging only two vanes in the terminal zone of the hoistway in an overlapping fashion as shown in FIG. 5, it is possible to in effect encode the three position checkpoints of the prior art in a binary way. This may be done e.g. by using the boundaries of the four distinct zones (00, 10, 11, 01) shown as position checkpoints. These two vanes can therefore be sensed using a lower cost stationary part 16*aa* having only two switches 16$aa_1$, 16$aa_2$ instead of the three of FIG. 4. It should also be noted that the material requirements for the three vanes of FIG. 4 constitute twice the length of the terminal zone. In contrast, for example, the material requirements of the two vanes of FIG. 5 constitute only one and one-third the length of the terminal zone. This represents a material savings of two-thirds the length of the terminal zone.

Figure 1:
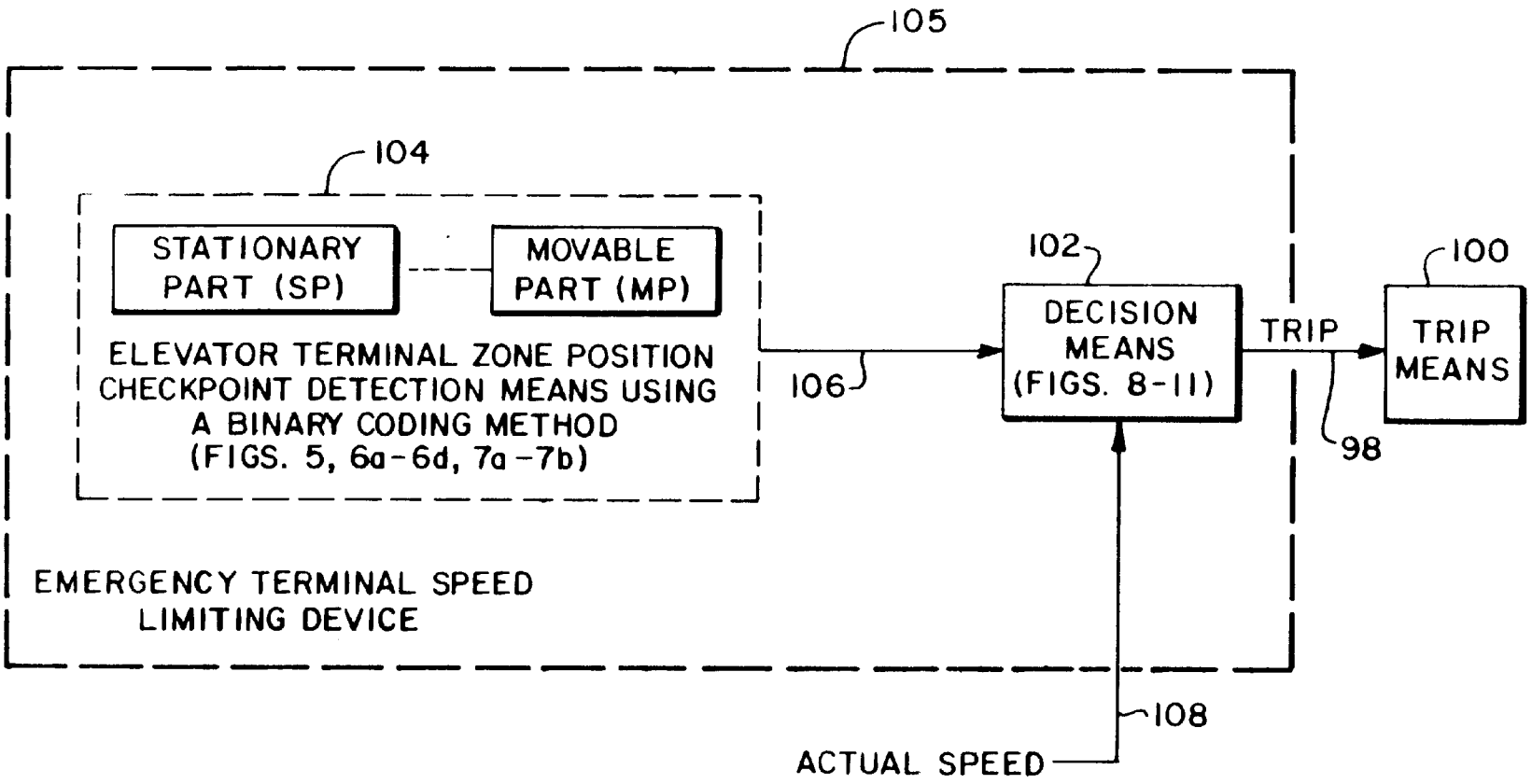
FIG. 1 illustrates an elevator hoistway terminal zone checkpoint detection apparatus using a binary coding method for use in an emergency terminal speed limiting device, according to the present invention.

Referring now to FIG. 1, an elevator hoistway terminal zone checkpoint detection apparatus 104 is shown using the above described binary coding method for use in an emergency terminal speed limiting device 105, according to the present invention. The elevator terminal zone position checkpoint detection means 104 is shown having both a stationary part and a movable part as described above. However, unlike the prior art, a binary coding method according to the present invention is used as shown for example in FIGS. 5, 6*a*–6*d*, and 7*a*–7*b*. In general, the stationary part has plural elongated sections, for vertical mounting or positioning along a terminal zone of the elevator hoistway. At least one section overlaps in part another section so as to form at least one overlapping portion and at least two non-overlapping portions. This provides a sensible binary coded subzone indicator. The movable part is mounted on the elevator car which is of course movable up and down the hoistway. The movable part therefore moves in conjunction with elevator car movement and is for sensing boundaries of the overlapping portion and the non-overlapping portions of the stationary part as being indicative of position checkpoints in the terminal zone. It provides a sensed output (checkpoint indicator) signal indicative of the position checkpoints. A checkpoint indicator signal on a line 106 is provided to a decision means 102 which is shown in more detail, for example, in FIGS. 8–11. The decision means is also responsive to an actual sensed velocity signal on a line 108. It provides a trip signal on a line 98 to a trip means 100 for stopping the elevator in case the actual speed of the elevator at one of the position checkpoints exceeds a reference velocity (maximum allowed) for that point.

Figure 6A:
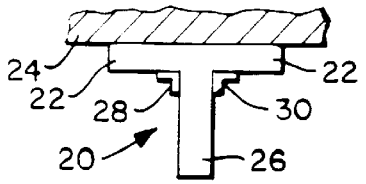
FIGS. 6*a*–6*c* together show a stationary part of a position check detection means having plural elongated reflective sections which overlap, according to the present invention, to provide a binary coded indication of position checkpoints in the hoistway.
Figure 6B:
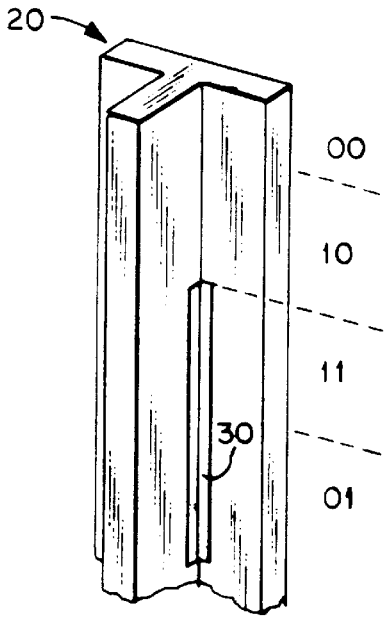
Figure 6C:
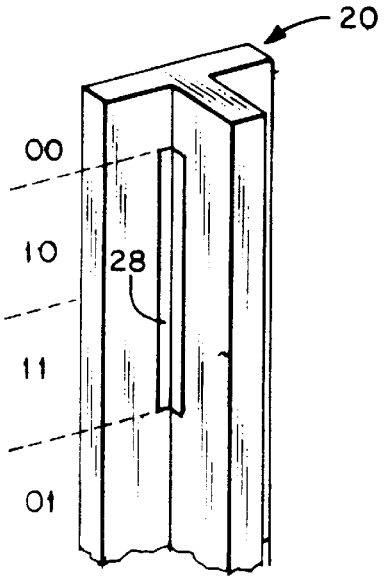
Figure 6D:
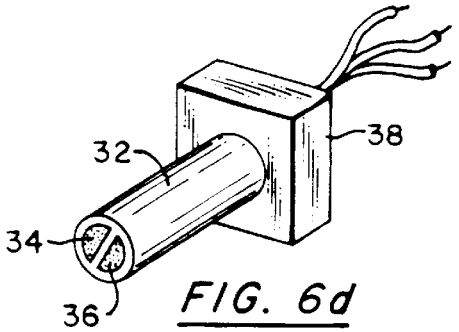
FIG. 6*d* shows a typical moving part of a position check detection means a plurality of which can be used with the stationary part of FIGS. 6*a*–6*c* for providing a position checkpoint output signal.

According to another embodiment of the invention, the stationary part of the of the elevator terminal zone position checkpoint detection means can be reflective sticky tape stuck in vertical strips on a convenient surface in the hoistway. FIG. 6*a* shows a simplified top view of an elevator hoistway rail 20 having a base 22 mounted on a hoistway wall 24 and having a blade 26 that is engaged by the rollers of roller clusters mounted on the top and bottom of the elevator car onto the rail 20. Reflective strips 28, 30 can be run along the rail. They can e.g. be stuck into the corners formed between the blade and the base. Or they can be stuck onto the rail in a manner similar to as shown in copending application Ser. No. 09/001,491 filed on Dec. 31, 1997 entitled "Retroreflective Elevator Hoistway Position Sensor" which is hereby incorporated by reference in its entirety. See particularly the disclosure thereof at page 3, line 1 through page 4, line 9 in connection with the sole FIGURE. FIG. 6*b* hereof shows a perspective view of the rail 20 with the tape 30 shown on one side of the blade 26. FIG. 6*c* shows a perspective view of the rail 20 from the other side with the tape 28 staggered so that it overlaps the tape 30 for part of its length, according to the binary coding method of the present invention. It should be realized that the rails are actually much longer than shown in FIGS. 6*b* & 6*c* and that shown is a much truncated illustration. The actual lengths of nonoverlap and overlap would normally be much longer. FIG. 6*d* shows an optical sensor 32 having a transmitter 34 for emitting light and a receiver 36 for receiving light reflected from the reflective tape. The sensor 32 can be mounted on the elevator car by means of a base 38 and can be positioned so as to be properly angled, e.g. at 45 degrees, toward the reflective tape as the car moves up and down the hoistway rail. One way to mount the sensors is shown in the figure of the above-mentioned case. Such a sensor is available from Pepperl & Fuchs, Germany, OSB3000-18GM70-E4, Part No. 82404, also available from the same firm in Twinsburg, Ohio. It should also be realized that other kinds of reflective means can be used such as polished metal, reflective paint, mirrored plastic or glass, etc., and that such can be anywhere in the hoistway and need not be on the rail.

Figure 7A:
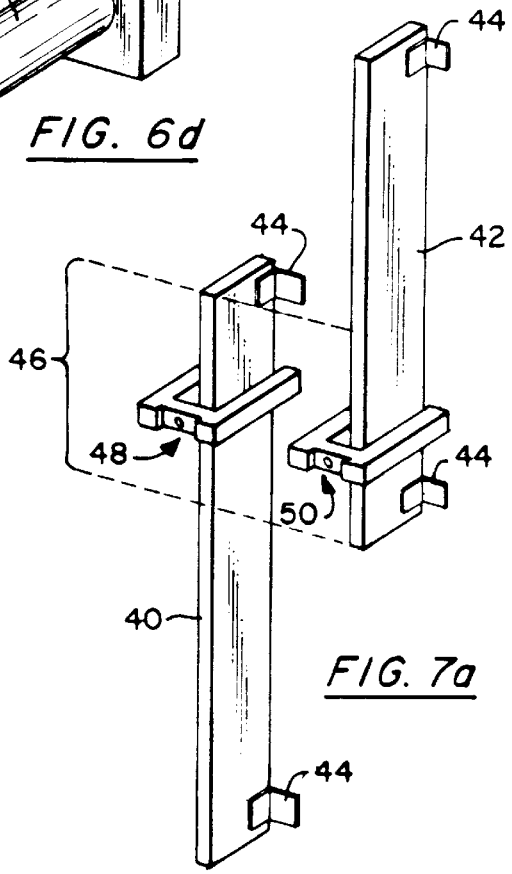
FIG. 7*a* illustrates a pair of elongated vane sections, similar to those of FIG. 5, which overlap in part for use with optical sensors shown in FIG. 7*b*.
Figure 7B:
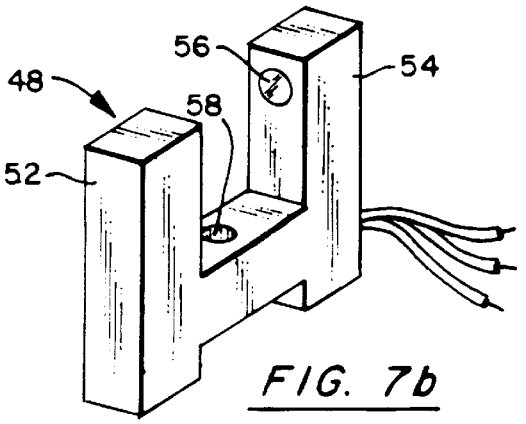
FIG. 7*b* illustrates an optical sensor for use with each of the vane sections of FIG. 7*a*.

Yet another embodiment is shown in FIGS. 7*a*–7*b*. A pair of vanes 40, 42 are shown bracketed to the hoistway wall by means of brackets 44 and are staggered so as to overlap in a central region 46 in accordance with the teachings of the present invention. Also in this embodiment, optical sensors 48, 50 are used. In this case, the vanes are used to break an optical beam passing between arms of a U-shaped holder. As shown in FIG. 7*b*, an optical sensor of this type has a pair of arms 52, 54. The arm 54 has an optical transmitter 56 which transmits a beam of light over to a receiver (not shown) in the other arm 52. The device 48 can be mounted on the elevator car by means of a through hole 58 in the device 48. In operation, when the device 48 passes by the vane 40, the beam of light is broken and that fact is signaled to the decision means of FIG. 1. Such a sensing device is available from the Toyo Company of Japan under Part No. J10629W1, called the "ADS-1".

Figure 8:
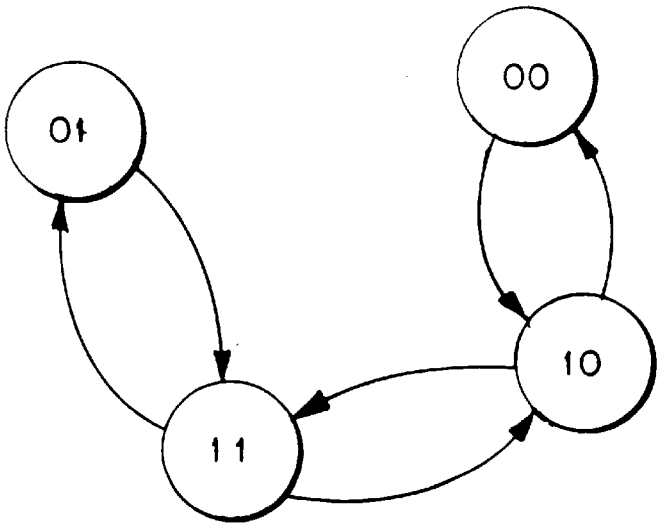
FIG. 8 shows a state diagram which illustrates possible transitions from state to state which are indicative of position checkpoints in the terminal zone of the elevator hoistway, according to the present invention.

At shown in FIG. 8, four distinct states are defined (as shown in FIG. 5) by a two bit binary code (00, 10, 11, 01), according to the present invention. The mid-hoistway area is defined as zone 00, while the other three zones together comprise the active region of the emergency terminal speed limiting device. When entering the terminal zone, the two bit code changes from 00 to 10, then from 10 to 11, and finally from 11 to 01. Of course, it will be realized that the vanes of FIG. 5 could be oriented differently with the vane 16$dd_1$ at the same vertical position but on the right and the vane 16$dd_2$ at the same vertical position on the left. In that case, the sequence would be 00, 01, 11, 10. As shown in FIG. 8, the transitions from state to state are reversible, depending on the direction travel of the elevator after it enters and departs from the terminal zone. A determination of the present state can be made in the decision means of FIG. 1 by means of the state diagram of FIG. 8 implemented in software.

Figure 9:
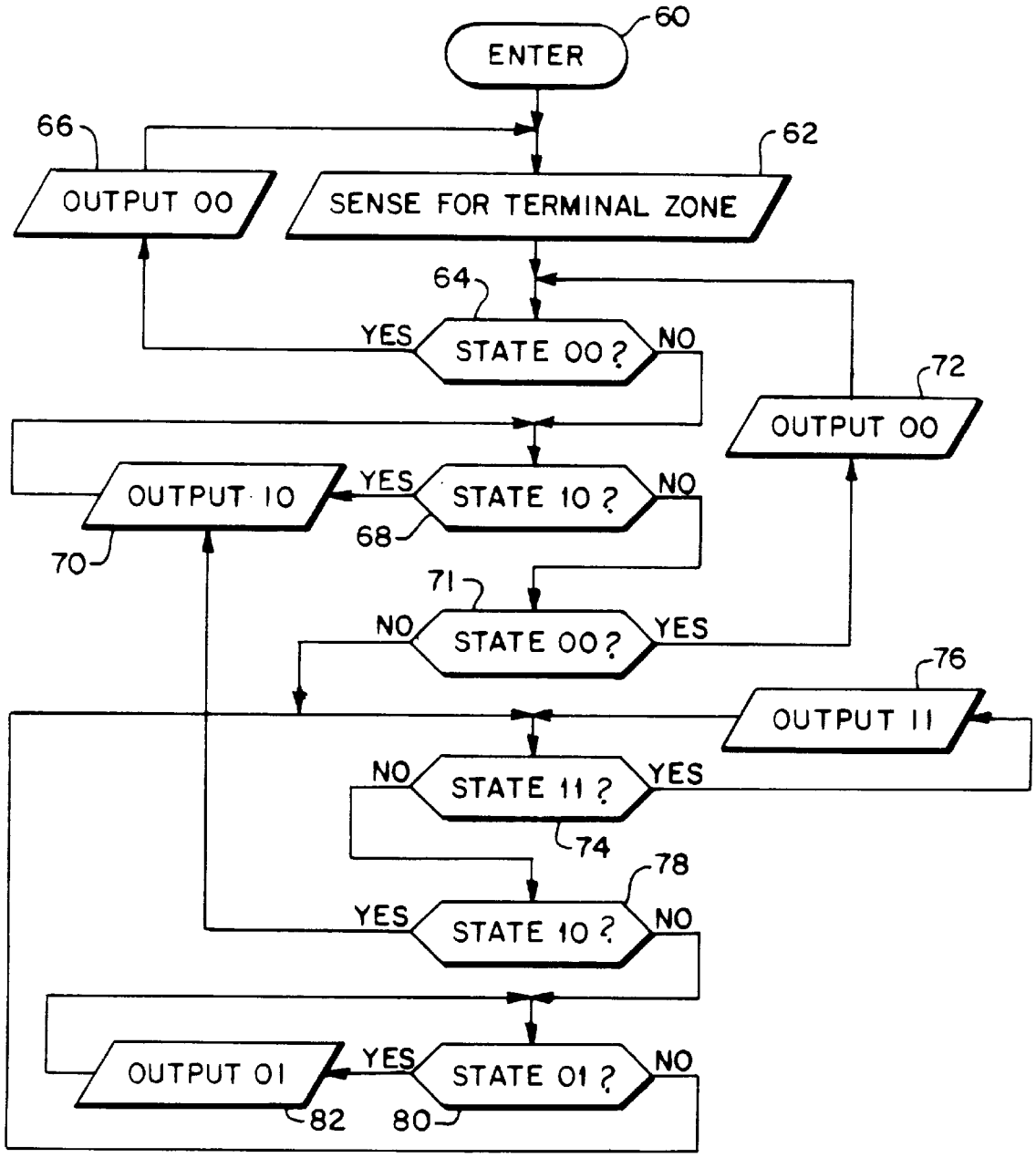
FIG. 9 is a flow chart which illustrates a series of steps which may be used in carrying out the state diagram of FIG. 8 in a signal processor for interpreting the output of the position checkpoint detection means of the present invention.

Similarly, a flow chart such as that shown in FIG. 9 could be used by the decision means of FIG. 1 to determine the present state. Such a sequence could be encoded as follows. After entering in a step 60, a step 62 is executed to sense for an indication from the sensors of the presence of the elevator car in the terminal zone. After registering the presence or lack of any such sensed signals, a determination is made in a step 64 as to whether or not the car is in state 00 (see FIG. 5). If so, an output indication of the presence of state 00 is made in a step 66 and the sensing step 62 is again executed.

This might not necessarily be an output signal but might rather be stored and used internally within the decision means of FIG. 1 for purposes to be described subsequently in connection with FIGS. 10 and 11 below. The step 64 would then again be executed and steps 66 and 62 repeatedly executed in a closed loop of steps 62,64,66 until the step 64 determines that the elevator car is no longer in the terminal zone at state 00. In that event, a step 68 is then executed to determine if the car is in a state 10. If so, an output 70 is next executed to provide an indication of the entry of the car into state 10 and step 68 is then reexecuted. Again, steps 68, 70 can then be repeatedly reexecuted until the elevator car leaves state 10. At that point, a step 70 is executed to determine if the car has reversed direction and is now leaving the terminal zone through state 00. If that is the case, a step 72 is executed to output and indication that the elevator car has entered state 00 to and the step 64 is then reexecuted. If it is determined in the step 70 that the elevator car has not reversed direction and is continuing deeper into the terminal zone, a step 74 will then next be executed to determine if the car is in the state 11. If so, a step 76 is executed to indicate that such is the case and step 74 is then reexecuted, along with step 76, until it is determined by the step 74 that the car has now left state 11. A step 78 is then executed to determine if the car has reversed direction and reentered state 10 and, if so, the output step 70 is reexecuted to so indicate and the decision step 68 is then reexecuted as well. If the decision step 78 determines instead that the car has not reentered state 10, then a step 80 is next executed to determine if the car has entered state 01. If so, a step 82 is then executed to indicate that fact and steps 80 and 82 are then reexecuted until the next step 80 determines that the elevator car has left state 01. If it has left state 01, the step 74 is next reexecuted to determine if it has now entered state 11. If so, the step 76 is executed to so indicate. The steps 74 and 76 may be reexecuted many times until it is determined by the step 74 that the elevator car is no longer in state 11. At that point, the step 78 may next be executed as described previously and the travel of the car through the terminal zone can be tracked as it leaves the terminal zone.

In the foregoing description of an algorithm according to FIG. 9, various output steps 66, 70, 72, 76, and 82 were described. A use for these indications is shown in FIG. 10. The routine of FIG. 10 may be running in parallel with the routine FIG. 9 in the decision means of FIG. 1, for example. After entering in a step 82, a step 84 is executed to receive or retrieve a stored sensed output 00, 10, 11 or 01 from the output steps 66, 70, 72, 76, 82 of FIG. 9. Once this is accomplished, a step 86 is next executed to retrieve a reference velocity corresponding to the sensed output state. A step 88 is then executed to retrieve the actual sensed velocity of the elevator car which is obtained from another source which is not pertinent to the present invention. A comparison of the reference velocity and the actual velocity and is then made in a step 90. If the actual velocity is greater than the reference velocity, as determined in a step 90, then a step to 94 is then executed to output a trip command to stop the elevator. Such a trip command signal is illustrated on a line 98 in FIG. 1 being provided to a trip means 100 such as the elevator brake. If the actual velocity is not greater than the reference velocity then a return is made in a step 96 and the routine of FIG. 10 may be reentered in the step 82, as desired.

Figure 10:
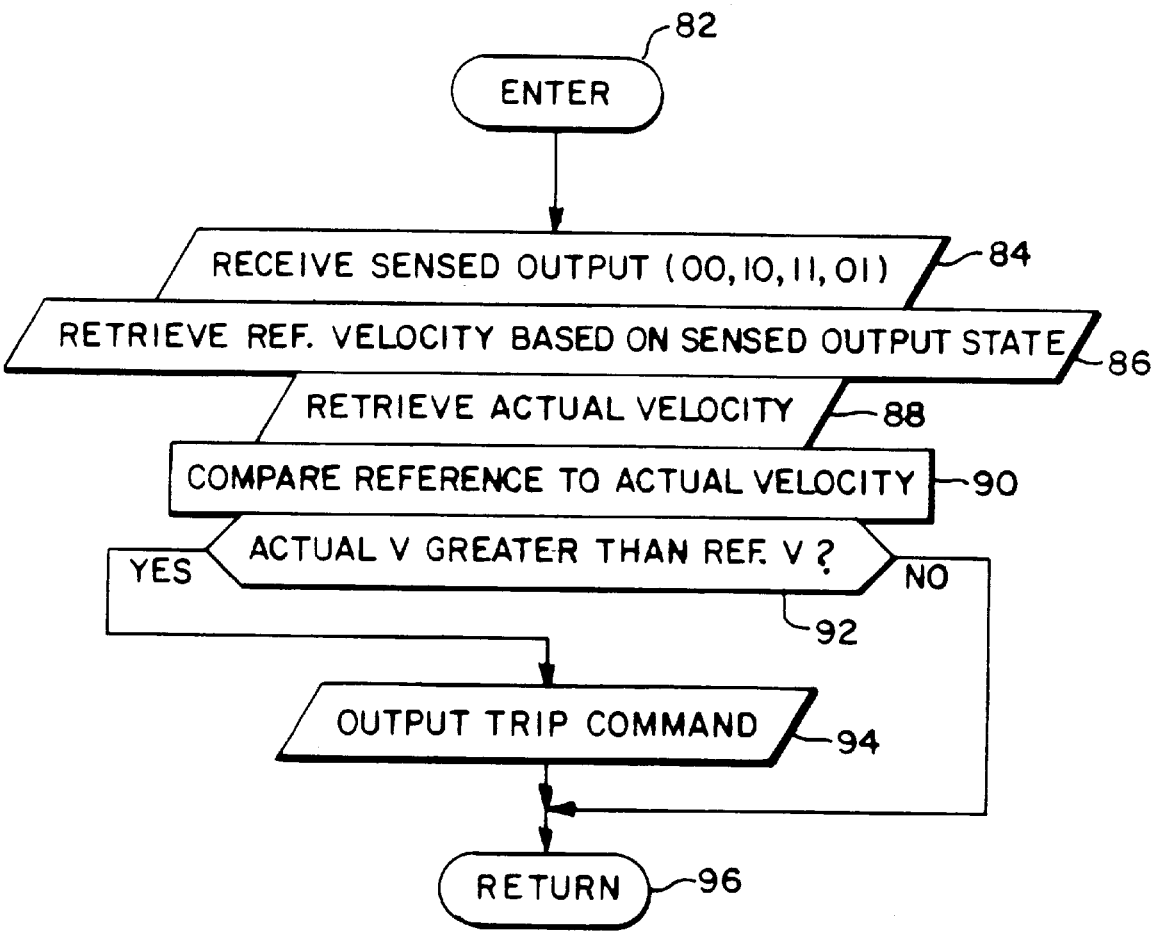
FIG. 10 is a flow chart that shows a series of steps which may be carried out in a signal processor for carrying out the functions of the decision means of FIG. 1.
Figure 11:
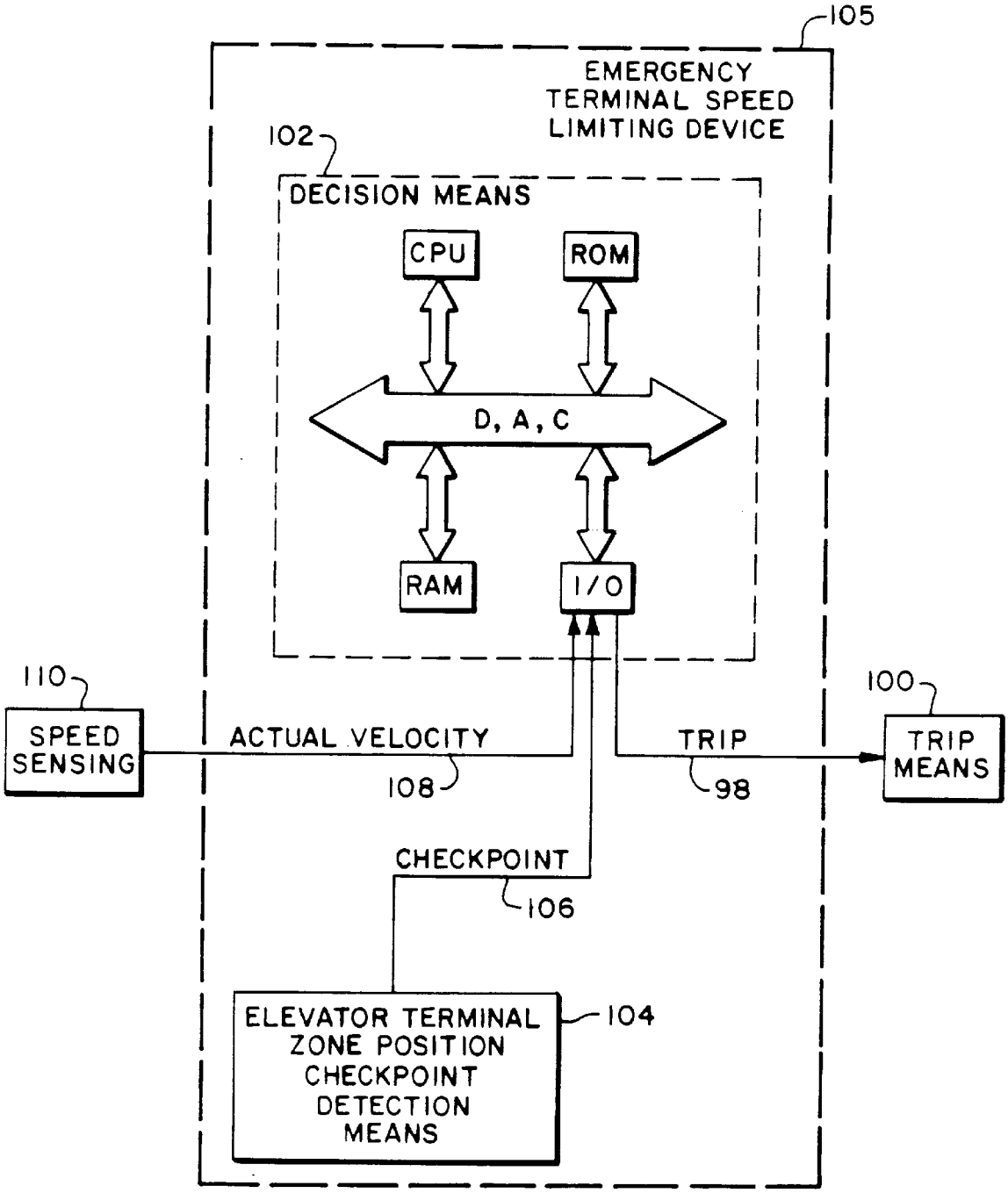
FIG. 11 shows an emergency terminal speed limiting device, according to the present invention, with the decision means of FIG. 1 implemented as a general purpose signal processor for carrying out the series of steps illustrated, for example, in FIGS. 9 and 10.

The algorithm shown in FIGS. 9 and 10 may be executed on a general-purpose signal processor 102 such as shown in FIG. 11 having a CPU, ROM, RAM and I/O, all interconnected by various data, address and control (D,A,C) busses. Such could fulfill the role of the decision means of FIG. 1, or such could be implemented in hardware or some combination of hardware and software, if desired. FIG. 11 also shows an elevator terminal zone position checkpoint detection means 104 which provides a checkpoint indication signal on a line 106 to the decision means 102. The decision means what was also responsive to an actual velocity signal on a line 108 from a speed sensing means 110 for use in the comparison and decision of steps 90, 92 of FIG. 10.

Although we invention has been shown and described with respect to a preferred embodiment thereof it will be understood by those skilled in the art that the foregoing and various other changes, omissions and deviations in the form and detail thereof may be made therein without departing from the spirit and scope of this invention.

We claim:

1. Elevator hoistway terminal zone position checkpoint detection apparatus, comprising:

a stationary part having plural elongated sections, for vertical mounting along a terminal zone of an elevator hoistway, having at least one section overlapping in part another section so as to form at least one overlapping portion and at least two non-overlapping portions; and a movable part, for mounting on an elevator car movable in said hoistway for sensing boundaries of said overlapping portion and said non-overlapping portions as indicative of position checkpoints in said terminal zone and for providing a sensed output signal indicative of said position checkpoints.

2. The elevator hoistway terminal zone position checkpoint detection apparatus of claim 1, wherein said elongated sections of said stationary part comprise vanes or cams for mounting along said terminal zone of said elevator hoistway.

3. The elevator hoistway terminal zone position checkpoint detection apparatus claim 2, wherein said movable part comprises at least two cam operated switches.

4. The elevator hoistway terminal zone position checkpoint detection apparatus of claim 2, wherein said movable part comprises optical sensors for sensing said vanes or cams.

5. The elevator hoistway terminal zone position checkpoint detection apparatus of claim 1, wherein said elongated sections of said stationary part comprise a light reflective means for mounting along said terminal zone of said elevator hoistway.

6. The elevator hoistway terminal zone position checkpoint detection apparatus of claim 5, wherein said movable part comprises optical sensors for sensing said light reflective means.

7. An elevator emergency terminal speed limiting device, comprising:

an elevator hoistway terminal zone position checkpoint detection means utilizing a binary coding method for providing a binary coded output signal indicative of position checkpoints in an elevator hoistway terminal zone; and decision means, responsive to said binary coded output signal, for retrieving a velocity reference signal corresponding to a position checkpoint associated with said binary coded output signal and for comparing said velocity references signal to an actual velocity signal indicative of an actual velocity of an elevator car in said elevator hoistway for providing a trip signal for stopping said elevator car in the presence of said actual velocity signal being greater than said velocity reference signal wherein said hoistway terminal zone position checkpoint detection means comprises:

a stationary part having plural elongated sections, for vertical mounting along a terminal zone of an elevator hoistway, having at least one section overlapping in part another section so as to form at least one overlapping portion and at least two non-overlapping portions; and a movable part, for mounting on an elevator car movable in said hoistway for sensing boundaries of said overlapping portion and said non-overlapping portions as indicative of position checkpoints in said terminal zone and for providing a sensed output signal indicative of said position checkpoints.

8. The elevator emergency terminal speed limiting device of claim 7, wherein said elongated sections of said stationary part comprise vanes or cams for mounting along said terminal zone of said elevator hoistway.

9. The elevator emergency terminal speed limiting device of claim 8, wherein said movable part comprises at least two cam operated switches.

10. The elevator emergency terminal speed limiting device of claim 8, wherein said movable part comprises optical sensors for sensing said vanes or cams.

11. The elevator emergency terminal speed limiting device of claim 7, wherein said elongated sections of said stationary part comprise a light reflective means for mounting along said terminal zone of said elevator hoistway.

12. The elevator emergency terminal speed limiting device of claim 11, wherein said movable part comprises optical sensors for sensing said light reflective means.

13. A method, comprising the steps of:

sensing for the presence of an elevator car in a terminal zone by:

determining if said elevator car is transitioning from outside said terminal zone into said terminal zone by detecting a transition from a zero state indicative of said elevator car outside said terminal zone to a first state corresponding to a first position checkpoint of said terminal zone in which a pair of elongated sections do not overlap for providing a first checkpoint binary output signal;

determining if said elevator car is transitioning from said first state to a second state corresponding to a second position checkpoint of said terminal zone in which said pair of elongated sections do overlap for providing a second checkpoint binary output signal; and determining if said elevator car is transitioning from said second state to a third state corresponding to a third position checkpoint of said terminal zone in which said pair of elongated sections again do not overlap for providing a third checkpoint binary output signal wherein the method further comprises the steps of:

receiving one of the binary output signals having a magnitude indicative of one of a plurality of position checkpoints in an elevator hoistway terminal zone of an elevator hoistway and;

retrieving, in response to said binary output signal, a reference velocity signal associated with said one checkpoint;

retrieving an actual car velocity signal having a magnitude indicative of an actual velocity of an elevator car moving in said elevator hoistway; and comparing said reference velocity signal to said actual car velocity signal for providing a trip command output signal in the presence of said actual car velocity signal having a magnitude greater than said reference velocity signal.

14. The method of claim 13, wherein said binary coded sensed output signal is provided by an elevator terminal zone position checkpoint detection means encoded using a binary coding method.

15. A method of sensing for the presence of an elevator car in a terminal zone, comprising the steps of:

determining if said elevator car is transitioning from outside said terminal zone into said terminal zone by detecting a transition from a zero state indicative of said elevator car outside said terminal zone to a first state corresponding to a first position checkpoint of said terminal zone in which a pair of elongated sections do not overlap for providing a first checkpoint output signal;

determining if said elevator car is transitioning from said first state to a second state corresponding to a second position checkpoint of said terminal zone in which said pair of elongated sections do overlap for providing a second checkpoint output signal; and determining if said elevator car is transitioning from said second state to a third state corresponding to a third position checkpoint of said terminal zone in which said pair of elongated sections again do not overlap for providing a third checkpoint output signal.

* * * * *